US005787502A

United States Patent [19]

Middleton

[11] Patent Number: 5,787,502

[45] Date of Patent: Aug. 4, 1998

[54] THERMOINSULATIVE PROTECTIVE GARMENTS

[76] Inventor: Nigel John Middleton, Tregone Cliff, Near Wadebridge, Cornwall, Great Britain, PL27 7QJ

[21] Appl. No.: 696,895

[22] PCT Filed: Feb. 17, 1994

[86] PCT No.: PCT/GB94/00323

§ 371 Date: Nov. 22, 1996

§ 102(e) Date: Nov. 22, 1996

[87] PCT Pub. No.: WO95/22262

PCT Pub. Date: Aug. 24, 1995

[51] Int. Cl.[6] ..... B63C 11/04

[52] U.S. Cl. ..... 2/69; 2/2.15; 2/2.16

[58] Field of Search ..... 2/456, 457, 458, 2/2.15, 2.16, 2.17, 69, 82, 243.1, DIG. 5

[56] References Cited

U.S. PATENT DOCUMENTS

| | | | |
|---|---|---|---|
| 3,771,170 | 11/1973 | Leon . | |
| 4,185,327 | 1/1980 | Markve . | |
| 4,704,092 | 11/1987 | Liukko . | |
| 4,739,522 | 4/1988 | Lassiter et al. | 2/458 |
| 5,140,721 | 8/1992 | Kauffeld | 2/458 |
| 5,267,519 | 12/1993 | Uglene et al. . | |

FOREIGN PATENT DOCUMENTS

| | | |
|---|---|---|
| 0153082 | 8/1985 | European Pat. Off. . |
| 0283556 | 9/1987 | European Pat. Off. . |
| 0251640 | 1/1988 | European Pat. Off. . |
| 1132535 | 11/1968 | Germany . |
| 2025316 | 5/1980 | United Kingdom . |
| 2242860 | 10/1991 | United Kingdom . |
| 9205843 U | 7/1992 | United Kingdom . |

*Primary Examiner*—Gloria Hale

*Attorney, Agent, or Firm*—Ronald I. Eisenstein; David S. Resnick; Dike, Bronstein, Roberts & Cushman, LLP

[57] ABSTRACT

A thermoinsulative protective garment comprising a first, outer, waterproof but vapor permeable, garment part for covering at least a part of the body of a wearer (preferably the whole body) and a second, inner, thermoinsulative garment part constituting a lining for the first garment part and sealingly bonded to the first garment part at least at the aperture(s) of the garment, so as to provide a layer of air between the garment parts, the second garment part including a thermoinsulative fabric sheet comprising a substantially impermeable closed-cell elastomeric (e.g. neoprene) sheet having perforations provided therethrough, each perforation of the sheet, or at least of a portion thereof, having at least one relatively wide region and at least one relatively narrow region along its length to define an internal chamber open to the inner side of the sheet and sufficiently closed to the outside of the sheet to permit moisture-laden air passing from the inner to the outer side of the sheet to accumulate in the chamber under increased pressure prior to passing out to the outer side of the sheet.

15 Claims, 2 Drawing Sheets

THERMOINSULATIVE PROTECTIVE GARMENTS

FIELD OF THE INVENTION

The present invention relates to thermoinsulative protective garments such as wet suits and cold or sea survival suits.

PRIOR ART

British Patent No. 1,132,535 describes a thermoinsulative protective suit including a water-tight and air-tight overall having an inner "lining" of a thermoinsulative voluminous synthetic thermoplastic fabric. The inner "lining" appears to constitute a separate suit worn below, but not connected to, the overall, although in the paragraph bridging the two columns of page 3 of the patent it is indicated that the fabrics of the overall and the "lining" may alternatively be firmly united together by sticking. The wearer's sweat is dissipated into the voluminous fabric of the inner lining and the suit provides insulation via a layer of air trapped between the overall and the inner lining, as well as air trapped within the voluminous fabric of the inner lining and between the inner lining and the wearer's skin.

Such suit systems are bulky and unsuitable for wear in non-emergency situations; even the lining on its own is too bulky for ordinary wear. The use of such suits is limited, therefore, to situations where there is sufficient time during the emergency for a wearer to gain access to, and don, both the inner "lining" sub-suit and the outer overall.

British Patent No. 2,242,860 describes a thermoinsulative protective fabric including a sheet of a substantially impermeable closed-cell elastomeric material having perforations provided therethrough, each perforation of the sheet (or at least of a portion thereof) having at least one relatively wide region and at least one relatively narrow region along its length to define an internal chamber open to a first side of the sheet (i.e. the side towards the wearer's skin) and sufficiently closed to the other side of the sheet (i.e. the side away from the wearer's skin) to permit moisture-laden air passing from the first to the other side of the sheet to accumulate in the chamber under increased pressure prior to passing out to the other side of the sheet. Such a fabric actively assists in removing moisture-laden air from the vicinity of the wearer's skin and is wearable in normal situations.

BRIEF DESCRIPTION OF THE INVENTION

We have now discovered that if an inner lining constructed from a fabric in accordance with GB-2,242,860 is provided in a garment having a waterproof but vapour permeable outer layer, the outer layer and lining being sealed together at least at the apertures of the garment so as to contain a layer of air between the outer layer and the inner lining, an extremely advantageous thermoinsulative clothing system is obtained, whereby the outer layer and lining components positively interact to enhance the advantages of the fabric of GB-2,242,860.

According to the present invention, there is therefore provided a thermoinsulative protective garment comprising a first, outer, waterproof but vapour permeable, garment part for covering at least a part of the body of a wearer and a second, inner, thermoinsulative garment part constituting a lining for the first garment part and sealingly bonded to the first garment part at least at the aperture(s) of the garment so as to contain a layer of air between the said garment parts, wherein the second garment part includes a thermoinsulative fabric sheet comprising a substantially impermeable closed-cell elastomeric sheet having perforations provided therethrough, each perforation of the sheet, or at least of a portion thereof, having at least one relatively wide region and at least one relatively narrow region along its length to define an internal chamber open to the inner side of the sheet (i.e. the side of the sheet directed towards the wearer's body) and sufficiently closed to the outer side of the sheet (i.e. the side of the sheet directed towards the outer garment part) to permit moisture-laden air passing from the inner to the outer side of the sheet to accumulate in the chamber under increased pressure prior to passing out to the outer side of the sheet.

The expressions "relatively wide" and "relatively narrow" mean that the respective regions of a perforation are wide and narrow relative to each other. The expression "fabric" includes a fabric portion, and the expression "sheet" includes a sheet portion.

It should be noted that the layer of air described above exists between the garment parts during normal use. In conditions of which external pressure (e.g. hydrostatic pressure when the garment is worn underwater) the garment parts may be pressed together so that no layer of air exists between the garment parts.

DETAILED DESCRIPTION OF THE INVENTION

The garment may take the form of a whole-body suit, a top-body or bottom-body garment, a garment for the extremities or any other garment providing for any desired extent of body cover. A whole-body suit is preferred in which gloves, shoes and/or balaclava portions may optionally be incorporated. The garment is relatively lightweight and tight-fitting, in comparison with prior garments having similar uses. The garment has the unique property of combining comfort in normal working use with an ability to provide thermal insulation and protection in the case of accidental cold water immersion. The garment has the advantage of buoyancy, in addition to thermal insulation, when used as a water-immersion suit.

The garment is suitably provided with resilient (e.g. rubber) aperture seals, preferably of the type conventionally used as cuff seals in dry-suit systems, to prevent entry of water between the lining part and the wearer's skin.

The outer garment part is preferably constructed from a conventional fabric having the required properties of being waterproof but vapour-permeable. Such fabrics may comprise microporous membranes and/or coatings, e.g. of a hydrophilic polymer (e.g. a polyurethane) to confer the required properties. Depending on the intended conditions of wear of the garment, the fabric of the outer garment part may be further treated to confer heatproofness, fireproofness, chemical-proofness and/or resistance to biological or radiation degradation or damage on the garment part. Any coating or similar special surface of the fabric may suitably be on the inner side of the first garment part (i.e. the side directed towards the second garment part), to protect the surface from external damage. The fabric of the outer garment part will also normally have sufficient durability, launderability and machinability so as to make manufacture, cleaning and maintenance of the garment acceptably simple and convenient.

The second garment part is preferably relatively close-fitting to the wearer. The elastomeric sheet of the second garment part is suitably formed of a closed-cell neoprene or other suitable closed-cell elastomeric polymer foam. The elastomeric sheet may suitably have a thickness in the range approximately 0.5 mm to 10 mm (for example about 5.0 mm). The sheet may be a unitary sheet or a laminate. In the case of a laminate, different materials may if desired be used for different lamina so as to provide a sheet having the desired properties.

Each perforation defines at least one chamber within the elastomeric sheet at the relatively wide region(s) of the perforation. A chamber is typically formed by a depression in that side of the sheet which is closer to the body of the user (the "inner" side), to partially enclose a volume of air directly above the user's skin.

The walls of each relatively narrow region of the perforations are suitably capable of resiliently expanding and contracting in use between a relatively closed condition, in which the perforation is practically closed off to permit air to accumulate in the chamber under increased pressure, and a relatively open condition, in which the air accumulated in the chamber can pass through the relatively narrow region to the outer side of the sheet.

Closure of the perforations to the outer side of the elastomeric sheet by a relatively narrow region of the perforation, in the resting condition of the sheet, may be complete or partial, and the materials and/or shape of the perforations are suitably chosen so that on stretching and/or bending of the sheet or one or more particular lamina thereof the relatively narrow region opens wider than its resting condition to allow exchange of air between the two sides of the sheet. Stretching/bending so as to cause the relatively narrow region of the perforation to open typically results from the desired build-up of pressure in the chamber and/or by movement of the fabric in use.

The arrangement may also suitably be capable of creating a pumping effect in the chamber(s) by the periodic stretching and/or bending of the fabric in use, to assist the exchange of air between the inner and the outer sides of the sheet.

In general, it is preferred that even at its widest stretch the relatively narrow region of the perforation is no more than about 65% of the widest width of the relatively wide region, and less (most preferably substantially less) in the resting condition of the sheet, e.g. less than about 50%, more preferably less than about 35%, for example less than about 15%, of the width of the relatively wide region in the resting condition of the sheet. Where the sheet is a laminate, different lamina may optionally be of different flexibility, and suitably the lamina including the relatively narrow region of the perforation may be of greater flexibility than the lamina including the relatively wide region, for example through being thinner and/or of a material of greater elasticity.

The walls of each chamber are suitably shaped so that the inner surface has a domed or conical configuration closing towards the relatively narrow region of the perforation at the apex, creating a structure whereby a back pressure from outside the sheet may tend to collapse the dome or cone to close the relatively narrow region at the apex, whereas a forward pressure from the inner towards the outer side of the sheet tends to open the relatively narrow region of the perforation.

The perforations and associated chambers are suitably of sufficient size and spacing apart to permit the natural biological functions of the user's skin to continue substantially unhindered over a desired period of time, while permitting a controlled (but not excessive) retention of the user's body heat. The perforations are suitably provided in the elastomeric sheet at a density of between about 500 and about 5,000 per square meter, e.g. about 2,500 per square meter.

The perforations are preferably provided in the elastomeric sheet by pressing the sheet in a suitable mould at a temperature of between about 100° C. and about 200° C., e.g. about 150° C., and a pressure of between about 50 psi (345 kPa) and about 150 psi (1034 kPa), e.g. about 100 psi (690 kPa). The pressed sheet typically has perforations which comprise hollow dome-like depressions in the inner surface of the sheet, forming the chambers or relatively wide region of the perforations, closing towards a relatively narrow region, at the apex of the dome, which passes through the sheet as a straight sided pore to the outer surface. Dome-like depressions in the inner surface of the sheet are suitably in the range from about 1.0 mm to about 18.0 mm, e.g. about 12.0 mm, in diameter and in the range from about 1 mm to about 10.0 mm, e.g. about 6.0 mm, in depth.

The internal diameter of the relatively narrow region of the perforation in its resting condition is suitably in the range from about 0.01 mm to about 5.0 mm, e.g. about 1.0 mm. As viewed from the outer side of the sheet, the tops of the domes project a short distance (suitably between about 0.5 mm and 5 mm, e.g. about 2.5 mm) above the surface and define dome-like projections from about 3.0 mm to about 20.0 mm, e.g. about 15.0 mm in diameter.

The elastomeric sheet may also include perforations of different configuration to those described in GB-2,242,860, e.g. conventional straight-sided fully open perforations. The sheet may also include unperforated regions.

The components of the second garment part should be non-toxic, non-irritant and comfortable to wear (in the sense of lightweight, flexible and soft to the touch), as well as being resistant to attack and degradation from all natural by-products of the user's body (e.g. sweat, blood, tissue fluid, urine, pus, and gases such as carbon dioxide). An internal layer of a skin-compatible fabric such as woven material, e.g. cotton, is preferably permanently bonded to the inner side of the second garment part.

In the case of fabrics in which the elastomeric sheet is a laminate, the lamina including the relatively narrow region of the perforation may suitably be of greater flexibility than the lamina including the relatively wide region.

The thermoinsulative fabric sheet of the second garment part is preferably arranged to regulate the wearer's skin temperature to normal body temperature (37° C.). This requires that the fabric functions as an insulator below body temperature and as a cooling medium above body temperature.

The capacity of the perforations to open above a threshold chamber pressure and/or temperature can be exploited to permit increased evaporative loss due to sweating from the skin surface as the body temperature exceeds 37° C., resulting in a skin temperature reduction through loss of latent heat of vaporisation from the skin. Thus, the fabric acts to cool the skin surface and maintain normal body temperature.

As the body temperature drops to 37° C. the production of sweat ceases and hence the cooling effect diminishes. This is seen as a continuous process resulting in the maintenance of homoiothermic biological conditions under varying environmental temperatures.

By selecting particular elastomeric materials, particular lamina thicknesses, particular sizes of relatively wide regions of perforations, particular sizes of relatively wide regions of perforations, different concentrations of perforations over the fabric area and/or different arrangements of perforation types over the area of the fabric, the fabric's properties can be adjusted to suit the intended use. Moreover, by careful selection of materials and configuration, the fabric can be made to respond in its "breathability" to variations in external conditions and/or in the user's biological functions, so that to some extent such fabrics can self-regulate their "breathability" and hence automatically control the environment next to the wearer's skin within a pre-set temperature range. In one particular form, the perforations open when the vapour pressure of moisture in the chamber(s) reaches saturated vapour pressure.

Particularly preferred for constructing the second garment part is the material marketed under the brand name STOMATEX (™) by St. Albans Rubber Limited, Stanley, County Durham, England.

As stated above, the first garment part overlies the thermoinsulative fabric sheet and the two enclose in normal use an intermediate layer of air. This itself acts as a heat regulator in that it can provide an insulating "blanket" effect within the garment while enabling cooling through permeation of water vapour through the first garment part, from whence the water vapour is lost to the surroundings. However in extreme external conditions of hydrostatic pressure underwater, the first garment part is pressed firmly against the second part, tending to close the perforations and cover them so that the wearer's body fluids are conserved.

The improved self-adjustability of the system to extreme conditions and combinations of circumstances is described in more detail below.

BRIEF DESCRIPTION OF THE DRAWINGS

The invention will now be described in greater detail, but without limitation, with reference to the accompanying drawings, in which.

DETAILED DESCRIPTION OF THE DRAWINGS

Figure 1:
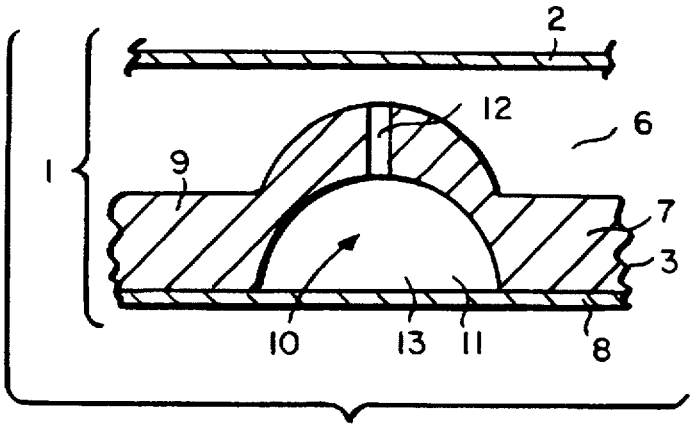
FIG. 1 shows in cross-section a portion of a garment.

Referring to the drawings, there is shown generally a thermoinsulative protective garment 1 comprising a first, outer, waterproof but vapour permeable, garment part 2 and a second, inner, thermoinsulative, garment part 3 constituting a lining for the first garment part 2.

Figure 2:
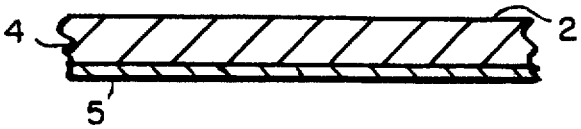
FIG. 2 shows in cross-section detail of an outer garment part.
Figure 3:
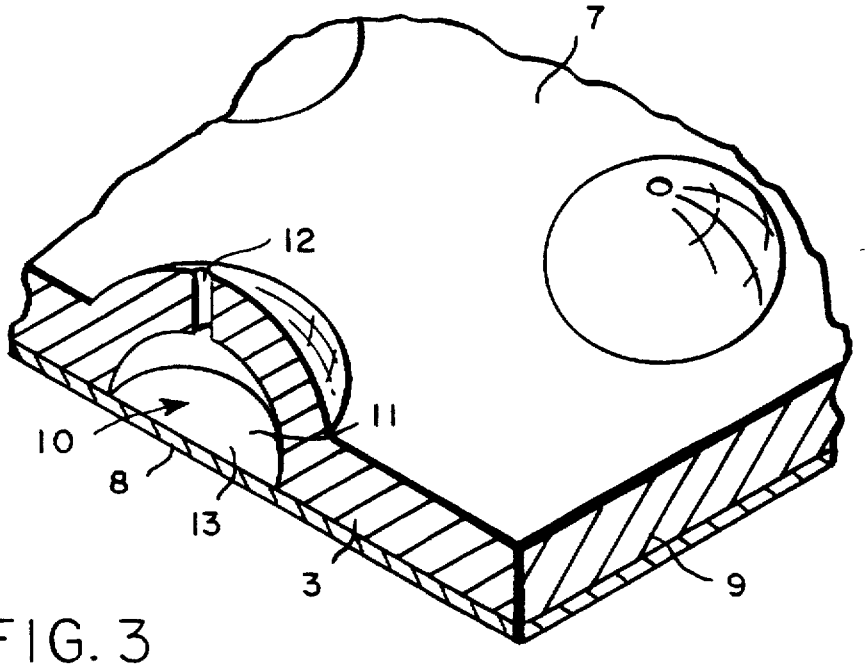
FIG. 3 shows in perspective and partial cross-section a portion of an inner garment part.

As shown in detail in FIG. 2, the first garment part 2 is formed of a conventional fabric 4 coated on one surface (preferably the inner surface in the made-up garment, i.e. the surface directed towards the second garment part 3) with a polymer layer 5, e.g. a polyurethane.

The fabric 4 of the first garment part 2 is vapour permeable and waterproof and preferably has one or more of the following additional properties: durability, heatproofness, fireproofness, chemicalproofness, resistance to biological and radiation dehydration or damage, launderability and machinability. Such properties can be conferred and/or enhanced by conventional treatments applied to the fabric, as will be readily understood by a worker of ordinary skill in this art.

The garment parts 2 and 3 are sealingly bonded to each other at least at the aperture(s) of the garment (as discussed in more detail below, with reference to FIG. 5) so as to contain a layer of air 6 between the garment parts.

The second garment part 3 comprises a thermoinsulative fabric sheet 7 and a porous woven fabric (e.g. cotton) layer 8 bonded to the sheet 7 to provide a soft surface in contact with the wearer's skin. Bonding is achieved via conventional adhesives.

The preferred thermoinsulative fabric sheet 7 is the commercially available STOMATEX (™) fabric (St. Albans Rubber Limited, Stanley, County Durham, England). It comprises a substantially impermeable closed-cell neoprene sheet of thickness about 5 mm, having perforations 10 provided therethrough, each perforation of the sheet 9 having a relatively wide region 11 and a relatively narrow region 12 along its length to define an internal chamber 13 open to the inner side of the sheet 9 and sufficiently closed to the outer side of the sheet 9 to permit moisture-laden air passing from the inner to the outer side of the sheet be accumulated in the chamber 13 under increased pressure prior to passing to the outer side of the sheet 9.

The chamber 13 is configured in the general form of a hollow dome, through the apex of which passes the relatively narrow region 12 of the perforation. The dome projects above the outer surface of the sheet 9 by a distance of about 2.5 mm and the diameter of the dome as apparent from the outer surface of the sheet is about 15 mm.

The internal dimensions of the chamber 13 are as follows: maximum internal diameter at the inner surface of sheet 9 approximately 12 mm; internal height approximately 6 mm.

The relatively narrow region 12 of the perforation connects the apex of the chamber 13 to the outer side of the sheet 9. The relatively narrow region 12 is in the form of a straight-sided pore of diameter approximately 1 mm.

The chambers 13 are provided in the fabric at a density of about 2,500 per square meter.

The sheet 9 is suitably formed by pressing a 5 mm thick sheet of closed-cell neoprene at a temperature of about 150° C. and a pressure of about 100 psi (690 kPa).

Figure 4:
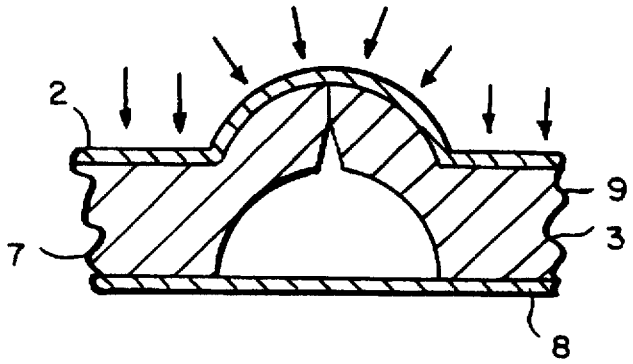
FIG. 4 shows in cross-section the garment portion of FIG. 1 when present in conditions of high external pressure.

FIG. 1 illustrates the garment in normal use on dry land. The air space 6 keeps the garment parts 2 and 3 separate and allows exchange of air through the perforations and the permeable outer part 2 into and out of the air space 6. If the wearer becomes immersed in water, however, the situation shown in FIG. 4 would prevail. In that event, the external hydrostatic pressure forces the garment parts 2 and 3 together and additionally forces the dome to collapse slightly, closing off the relatively narrow region 12 of the perforation 10, thus preserving the wearer's body fluids and transforming the chambers 13 into air pockets which enhance the insulating and buoyancy effect of the neoprene sheet 9.

Figure 5:
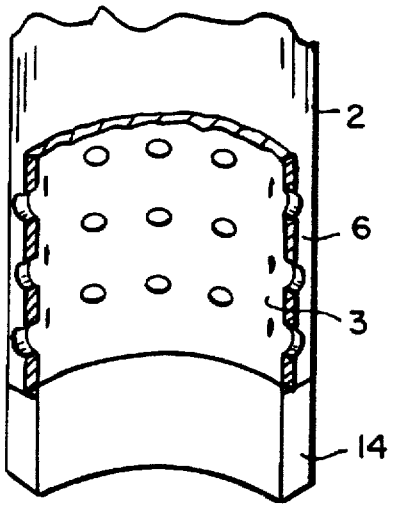
FIG. 5 shows a partial cut-away perspective detail of cuff (or other aperture) seals, and relationship of parts of the garment.

Referring now to FIG. 5, the seal between the garment parts 2 and 3 at a cuff or other aperture of the garment (e.g. ankle, wrist or neck) is shown. The parts 2 and 3 are bonded together by conventional adhesives and the whole aperture is elasticated at the extremity 14, in a manner well known in dry-suit construction so as to form a watertight seal around the wearer's body, e.g. at the wrists, ankles and/or neck.

The garment is suitably a whole-body garment, with or without glove, shoe and/or balaclava parts. The garment is suitably machined in two parts in conventional manner from the materials of the garment parts 2 and 3 and the inner lining part is then positioned within the outer part and the parts sealed together at the garment apertures with adhesive. Waterproof slide fasteners are provided to allow the garment to be put on and taken off. The inner garment is intended to be relatively tight fitting, but allowance should be made for use of undergarments. The outer garment part is generally less closely tailored, so as to leave the desired layer of air between the parts, and to accommodate pockets and other normal details.

It is preferred that the only points of seal between the garment parts are at the apertures, with free movement and an air space between the garment parts at all other points.

All seams are constructed in conventional manner so as to render them impermeable to liquid water.

INDUSTRIAL APPLICATION

There now follows a description of the function of the system as a means for protection from unfavourable environmental conditions. The system is intended to provide user comfort and protection in a wide variation of environmental conditions.

Under conditions of dry usage the elastomeric sheet provides protection from variance in environmental temperature (e.g. extreme heat or cold) by virtue of its poor thermal conductivity. At the same time the external fabric component provides durability and protection against rain, wind, fire, chemicals, radiation etc.

The chambers and pores of the elastomeric sheet provide a means of allowing vapour transfer from the user into the air space between the two components. This maintains a relatively dry and comfortable environment at skin surface for the user. The exhausted water vapour can then leave the system by passing through the vapour permeable coating of the external fabric.

During cold water immersion the pressure of the water compresses the domes and causes closure of the communicating pores. With the closure of the communicating pores, the thermal integrity of the insulative elastomeric sheet component is re-established.

The system is waterproof by virtue of the hydrophilic polymer coating and therefore no water can enter the space between the two components of the system. If accidental water entry occurs the elastomeric lining sheet will act as a semi-dry suit and therefore its thermal efficiency will not be compromised. Air trapped between the garment parts, within the closed-off perforations of the second garment part, and within the closed-cell structure of the second garment part, creates buoyancy to maintain the wearer afloat.

The suit is intended for use in dry conditions for extended periods of time, having the ability to transform into a semi-dry suit upon immersion in water.

Ideally this system is intended to cover the whole surface of the body except the face, with a single integral suit. However the system can be utilised in the construction of particular items of clothing, i.e. jacket, trousers, gloves, shoes, balaclavas.

I claim:

1. A thermoinsulative protective garment comprising a first, outer, waterproof but vapour permeable, garment part for covering at least a part of the body of a wearer, wherein said garment part has at least one aperture, and a second, inner, thermoinsulative garment part constituting a lining for the first garment part and sealingly bonded to the first garment part at least at the aperture(s) of the garment so as to contain a layer of air between the said garment parts, wherein the second garment part includes a thermoinsulative fabric sheet comprising a substantially impermeable closed-cell elastromeric sheet having an inner side and an outer side and perforations provided therethrough, each perforation of the sheet, or at least of a portion thereof, having a first end open to the inner side of the sheet, a second end open to the outer side of the sheet and a wall between the first and second ends, and further having at least one relatively narrow region along its length to define an internal chamber open to the inner side of the sheet and sufficiently closed to the outer side of the sheet to permit moisture-laden air passing from the inner to the outer side of the sheet to accumulate in the chamber under increased pressure prior to passing out to the outer side of the sheet.

2. A garment according to claim 1, wherein the substantially impermeable closed-cell elastomeric sheet is formed of closed-cell neoprene.

3. A garment according to claim 1, wherein the outer garment is constructed from a fabric provided with a coating to confer waterproofness and vapour permeability.

4. A garment according to claim 3, wherein the coating comprises a polyurethane.

5. A garment according to claim 2 wherein the outer garment is constructed from a fabric provided with a coating to confer waterproofness and vapor permeability.

6. A garment according to claim 5, wherein the coating comprises a polyurethane.

7. A garment according to claims 1, 2, 3, 4, 5 or 6, wherein the wall of each relatively narrow region of the perforations of the thermoinsulative fabric sheet of the second garment part is capable of resiliently expanding and contracting in use between a relatively closed condition, in which the perforation is sufficiently closed to permit air to accumulate in the relatively wide region of the perforation under increased pressure, and a relatively open condition, in which the air accumulated in the relatively wide region can pass through the relatively narrow region to the outer side of the sheet.

8. A garment according to claim 7, wherein the wall of each relatively wide region of the perforations of the thermoinsulative fabric sheet of the second garment part is shaped so that the internal chamber has either a hollow dome-like configuration or a hollow conical configuration, wherein said configuration is shaped so that it closes in a relatively narrow region at the dome's apex or the cone's apex.

9. A garment according to claim 8, which is in the form of a whole-body garment.

10. A garment according to claim 9, wherein the garment has sufficient inherent buoyancy to maintain an adult human wearer of the garment afloat in water.

11. A garment according to claims 1, 2, 3, 4, 5 or 6, wherein the wall of each relatively wide region of the perforations of the thermoinsulative fabric sheet of the second garment part is shaped so that the internal chamber has either a hollow dome-like configuration or a hollow conical configuration, wherein said configuration is shaped so that it closes in a relatively narrow region at the dome's apex or the cone's apex.

12. A garment according to claims 1, 2, 3, 4, 5, or 6, wherein said garment is in the form of a whole-body garment.

13. A garment recording to claim 11, wherein said garment is in the form of a whole-body garment.

14. A garment according to claim 12 wherein the garment has sufficient inherent buoyancy to maintain an adult human wearer of the garment afloat in water.

15. A garment according to claim 13, wherein the garment has sufficient inherent buyoyancy to maintain an adult wearer of the garment afloat in water.

* * * * *